US009561419B2

(12) United States Patent
Lo

(10) Patent No.: US 9,561,419 B2
(45) Date of Patent: Feb. 7, 2017

(54) BICYCLE TRAINER WITH A BICYCLE WHEEL HOLDING FIXTURE

(71) Applicant: GIANT MANUFACTURING CO., LTD., Taichung (TW)

(72) Inventor: Wen-Hai Lo, Taichung (TW)

(73) Assignee: GIANT MANUFACTURING CO., LTD., Taichung (TW)

( * ) Notice: Subject to any disclaimer, the term of this patent is extended or adjusted under 35 U.S.C. 154(b) by 0 days.

(21) Appl. No.: 14/606,498

(22) Filed: Jan. 27, 2015

(65) Prior Publication Data

US 2016/0096099 A1 Apr. 7, 2016

(30) Foreign Application Priority Data

Oct. 1, 2014 (TW) ..... 103217529 U

(51) Int. Cl.
*A63B 69/16* (2006.01)
*A63B 23/04* (2006.01)

(52) U.S. Cl.
CPC ..... *A63B 69/16* (2013.01); *A63B 23/0476* (2013.01); *A63B 2069/165* (2013.01)

(58) Field of Classification Search
CPC ..... A63B 69/16–2069/168; B62H 1/04; B62H 3/04–3/06
See application file for complete search history.

(56) References Cited

U.S. PATENT DOCUMENTS

| | | | | |
|---|---|---|---|---|
| 4,768,782 | A | 9/1988 | Blackburn | |
| 6,203,472 | B1 * | 3/2001 | McCaffrey | A63B 69/16 434/61 |
| 2001/0041648 | A1 * | 11/2001 | Schroeder | A63B 69/16 482/61 |
| 2003/0125167 | A1 * | 7/2003 | Copeland | A63B 69/16 482/61 |

* cited by examiner

*Primary Examiner* — Loan H Thanh
*Assistant Examiner* — Jennifer M Deichl
(74) *Attorney, Agent, or Firm* — Muncy, Geissler, Olds & Lowe, P.C.

(57) ABSTRACT

A bicycle trainer includes a body having two spaced positioning portions for supporting the wheel axle of a bicycle wheel, a damper unit for giving a damping resistance to the bicycle wheel, and a holding fixture mounted at the two positioning portions of the body for securing the bicycle wheel in a non-coaxial manner relative to the axial direction of the wheel axle. Thus, the invention can conveniently, rapidly and steadily secure the bicycle wheel in position.

8 Claims, 13 Drawing Sheets

BICYCLE TRAINER WITH A BICYCLE WHEEL HOLDING FIXTURE

BACKGROUND OF THE INVENTION

1. Field of the Invention

The present invention relates to bicycle training technology and more particularly, to a bicycle trainer, which provides a holding fixture for conveniently, rapidly and steadily securing a bicycle wheel 2. Description of the Related Art Bicycle trainer is highly appreciated by bike enthusiasts for the advantage that it enables a bicycle rider to ride a bicycle while it remains stationary, helping the rider achieve the purpose of self-training in an easy way without requiring an expensive bike-style fitness equipment, A conventional bicycle trainer, as illustrated in U.S. Pat. No. 4,768,782 (hereinafter called as patent 782), mainly comprises two U-shaped support brackets 20, 22 that have the top ends thereof pivotally connected together and the bottom ends kept apart and supported on the ground. The rear wheel 14 of the bicycle is supported between arms of the U-shaped support brackets 20, 22. The two top ends of each of the U-shaped support brackets 20, 22 are respectively provided with a threaded wheel mounting bolt 42 that is disposed in alignment with the wheel axle 48 of the rear wheel 14. The inner end of each mounting bolt 42 is formed with an axle engaging cup 46 which acts to engage and support the protruding axle 48 of the rear wheel 14. The outer perimeter of the rear wheel 14 directly touches the load member 18 that provides resistance to the rear wheel 14. Thus, the U-shaped support brackets 20, 22 lift the rear wheel 14, and the rear wheel 14 engages a load member 18, such that the pedaling of the bicycle by the user causes the rear wheel 14 to rotate the load member 18 to provide resistance and thus exercise to the user.

However, when operating the aforesaid 782 patent or similar bicycle trainer to secure the bicycle wheel, the user needs to hold and slightly lift the bicycle with one hand, and rotate each of the left and right mounting bolts in the axial direction of the wheel axle with the other hand. This mounting procedure is very inconvenient. Further, the two mounting bolts must be fastened to the bicycle wheel tightly. The user can neither pre-position the bicycle wheel, nor accurately control the bicycle wheel clamping tightness. Clamping the bicycle wheel excessively tight can damage the bicycle wheel or the bicycle frame, or the bicycle wheel can fall out of the bicycle trainer if it is loosely clamped, causing troubles and increasing dangers.

SUMMARY OF THE INVENTION

The present invention has been accomplished under the circumstances in view. It is the main object of the present invention to provide a bicycle trainer, which comprises a holding fixture for conveniently, rapidly and steadily securing a bicycle wheel.

To achieve this and other objects of the present invention, a bicycle trainer of the invention is adapted for securing a bicycle wheel. The bicycle wheel is rotatable on a wheel axle thereof. The bicycle trainer comprises a body, a damper unit, and a holding fixture. The body comprises two spaced positioning portions. The bicycle wheel is supported between the two positioning portions by means of the wheel axle. The damper unit provides resistance to the bicycle wheel. The holding fixture is mounted at the two positioning portions of the body. The holding fixture secures the bicycle wheel in a non-coaxial direction relative to the axial direction of the wheel axle. Thus, the invention achieves the object of conveniently and rapidly securing the bicycle wheel.

Preferably, the non-coaxial direction relative to the axial direction of the wheel axle is the direction of gravity.

Preferably, the holding fixture comprises two clamp assemblies. Each clamp assembly comprises a holder base, a cover member, a lever, and a connecting member. The holder base comprises a recess extending along the axial direction of the wheel axle. The cover member is pivotally connected to the holder base for closing the recess of the holder base. The cover member comprises a retaining portion. The lever comprises a hook. The connecting member is pivotally coupled between the lever and the holder base such that the lever can be biased relative to the holder base to force the hook into engagement with the retaining portion of the cover member, or to release the hook from the retaining portion.

Preferably, the body comprises a framework, and a swivel frame pivotally connected to one side of the framework. The swivel frame comprises two support bars arranged in parallel. Each support bar has a top end terminating in a positioning portion. Thus, the swivel frame can be biased to lift the support bars from the framework, or to have the support bars be received to the framework. The damper unit is mounted at the framework to face toward the support bars of the swivel frame.

To prevent causing damage to the bicycle trainer or the bicycle frame, the invention further provides a quick-release device that extends along the wheel axle of the bicycle wheel. The quick-release device is mounted at the two support bars of the body.

Other advantages and features of the present invention will be fully understood by reference to the following specification in conjunction with the accompanying drawings, in which like reference signs denote like components of structure.

DETAILED DESCRIPTION OF THE INVENTION

Prior to viewing the following specification in conjunction with the accompanying drawings, it is to be understood that the bicycle trainer of the present invention can be used for bike pedaling training exercises, or simply for supporting a bicycle. Further, the directional terms or similar terms to describe the shape, such as semicircular, cylindrical, front, rear, top, bottom, "recessing, "protruding, "clockwise, "counter-clockwise, etc. throughout the specification are simply exemplary directional description languages, not intended for use to limit the scope of the claims.

Figure 1:
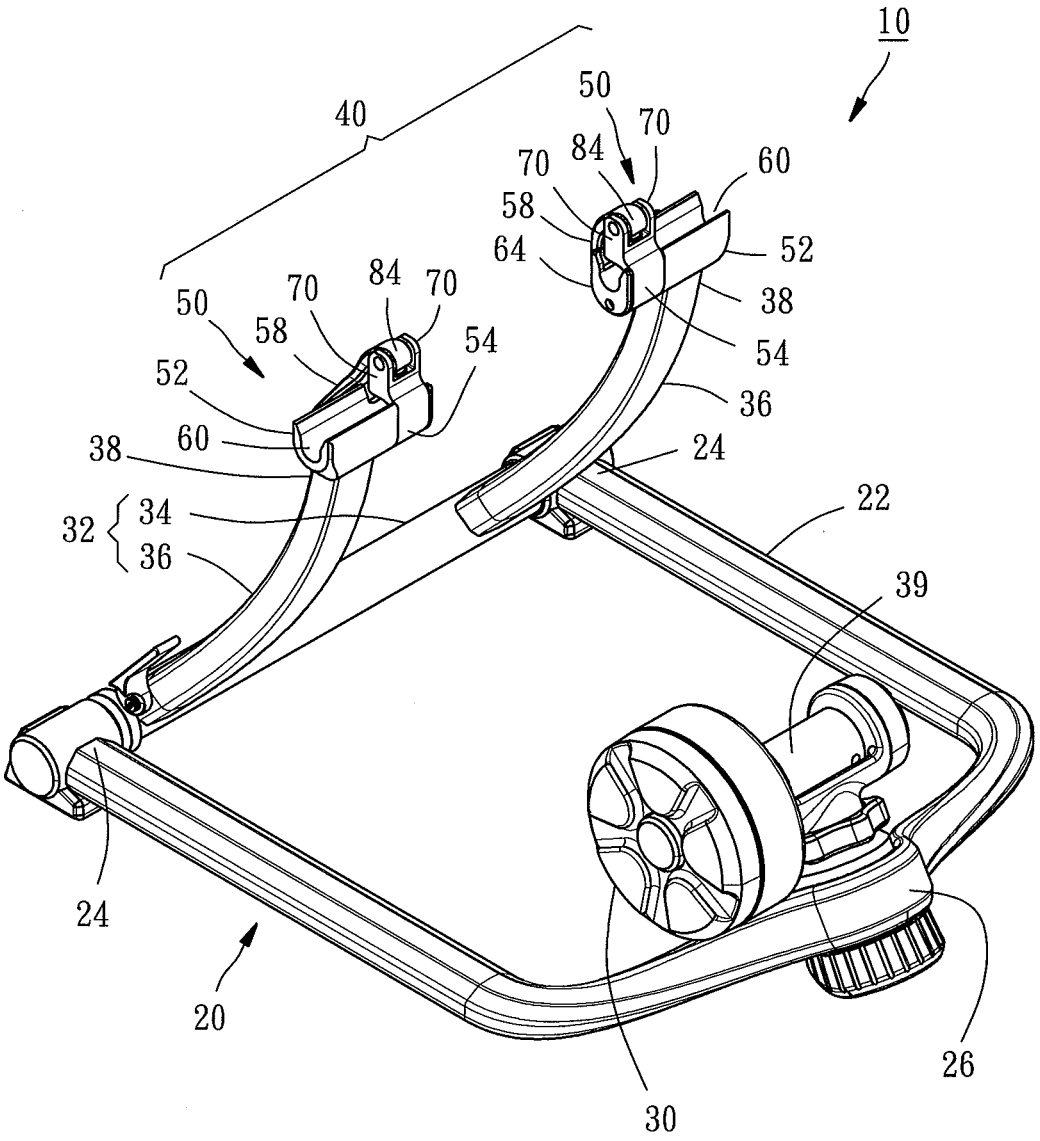
FIG. 1 is an oblique top elevational view of a bicycle trainer in accordance with a first embodiment of the present invention.
Figure 2:
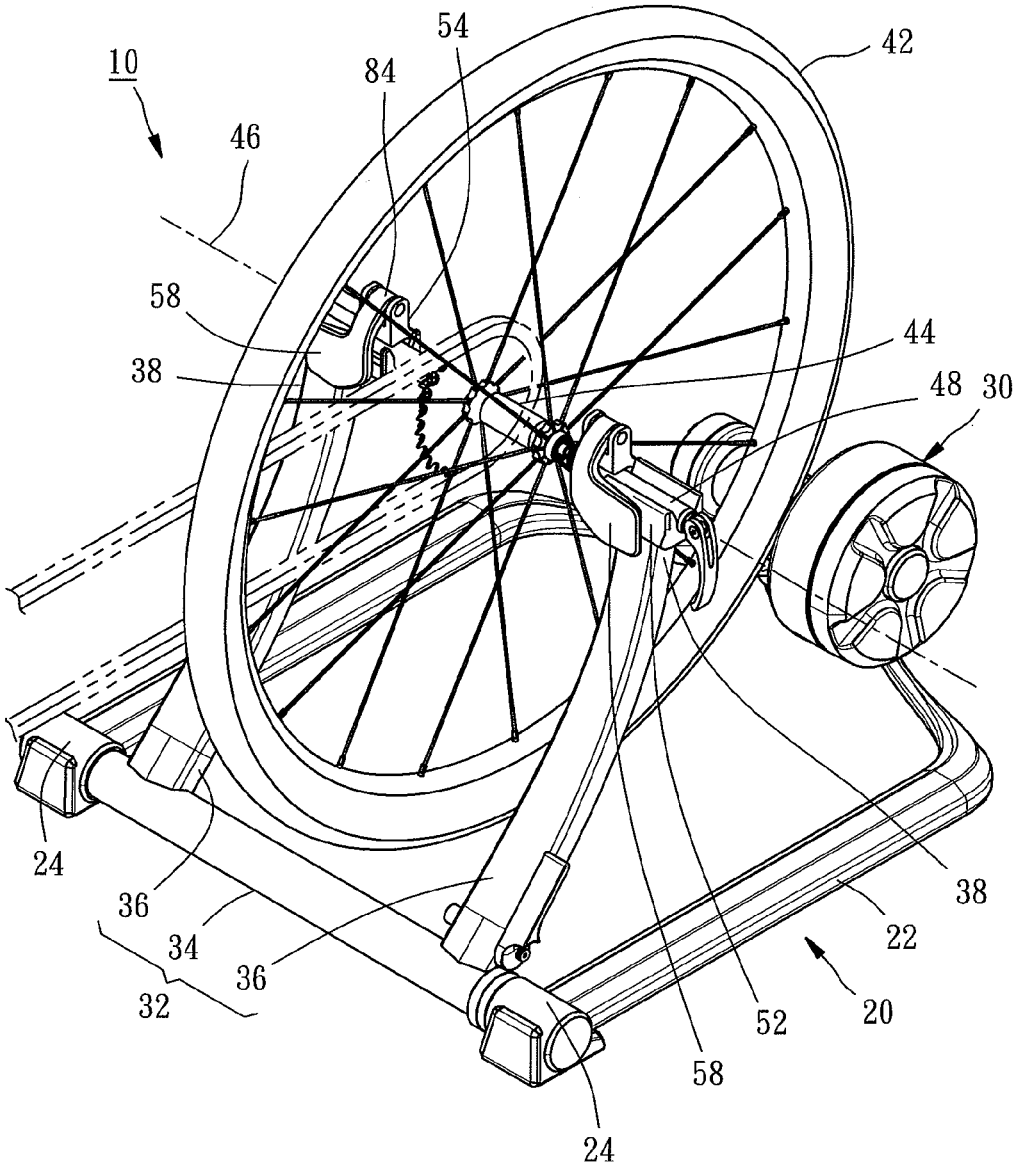
FIG. 2 is a schematic applied view of the bicycle trainer in accordance with the first embodiment of the present invention.
Figure 3:
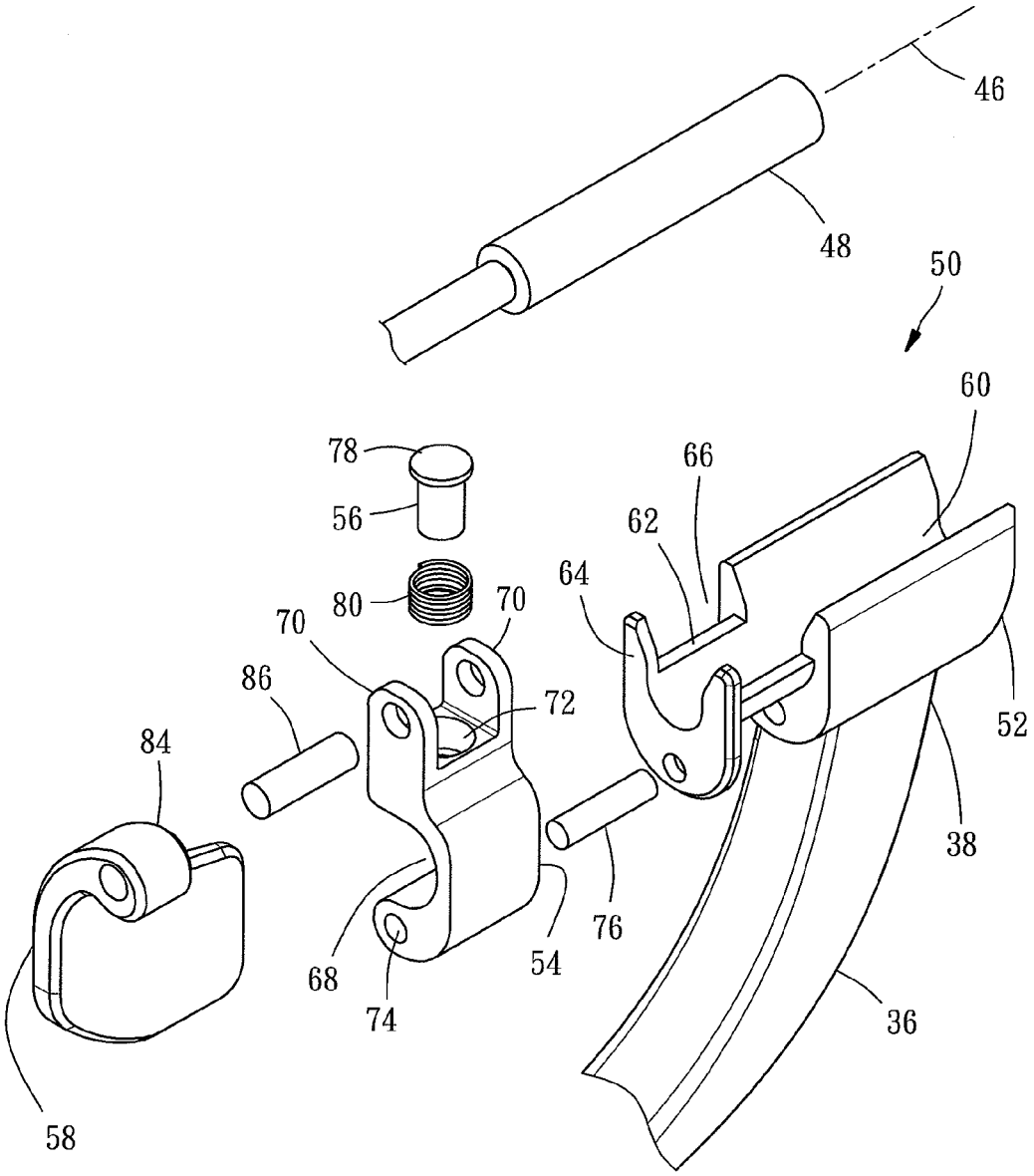
FIG. 3 is an exploded view of a part of the bicycle trainer in accordance with the first embodiment of the present invention, illustrating the configuration of the holding fixture.

Referring to FIGS. 1-3, a bicycle trainer 10 with a bicycle wheel holding fixture in accordance with a first embodiment of the present invention is shown. The bicycle trainer 10 comprises a body 20, a damper unit 30, and a holding fixture 40. The body 20 comprises a framework 22 having two end portions 24 spaced at one side thereof and a receptacle 26 located at an opposite side thereof, and a swivel frame 32 pivotally coupled between the two end portions 24. The swivel frame 32 comprises a base bar 34 and two support bars 36 extended from the base bar 34 in a parallel relationship. Each support bar 36 has a positioning portion 38. The base bar 34 has two opposite ends thereof respectively pivotally coupled to the two end portions 24 of the framework 22, enabling the swivel frame 32 to be biased relative to the framework 22 so that the two support bars 36 can be lifted from or received to the framework 22. The damper unit 30 comprises a roller set 39. The damper unit 30 is mounted in the receptacle 26 of the framework 22, enabling the roller set 39 to face toward the support bars 36 of the swivel frame 32.

Referring to FIGS. 1-3 again, the holding fixture 40 is mounted at the positioning portions 38 of the support bars 36 to detachably holding a bicycle wheel 42. The bicycle wheel 42 is selectively equipped with a quick-release device 48 in alignment with the axial direction 46 of the wheel axle 44. By means of connecting the quick-release device 48 to the holding fixture 40, the bicycle wheel 42 is supported on the two support bars 36 to keep the axial direction 46 of the wheel axle 44 in alignment between the two positioning portions 38. After the bicycle wheel 42 is secured to the support bars 36 by the holding fixture 40, enabling the tread of the bicycle wheel 42 rotatably supported on the roller set 39 of the damper unit 30. In this embodiment, the bicycle wheel 42 is the rear wheel of a bicycle. In order to simplify the content of the drawings, the bicycle frame, transmission mechanism and other components of the bicycle are not shown.

Figure 4:
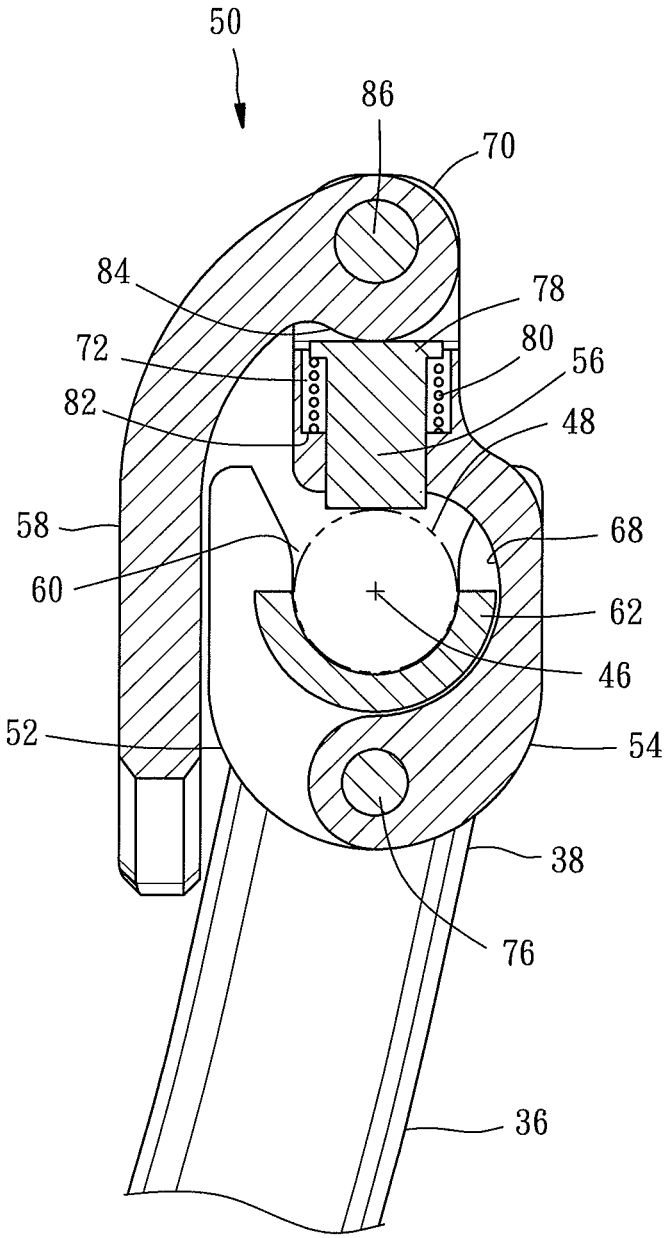
FIG. 4 is a sectional view of a part of the bicycle trainer in accordance with the first embodiment of the present invention, illustrating the quick-release device secured to the holding fixture.

Referring to FIG. 4 and FIG. 3 again, the holding fixture 40 comprises two clamp assemblies 50. Each clamp assembly 50 comprises a holder base 52, an engagement member 54, a holding-down member 56, and a lever 58. The two holder bases 52 are respectively mounted at the two positioning portions 38 of the support bar 36. Each holder base 52 defines a recess 60. The cross-sectional shape of the recess 60 curves inwards from the top wall of the holder base 52. Further, the recess 60 extends through the holder base 52 in the axial direction 46 of the wheel axle 44 of the bicycle wheel 42, so that the quick-release device 48 can be steadily placed on the two holder bases 52 along a direction non-coaxial to the axial direction 46, i.e., the vertical direction from top to bottom, enabling the bicycle wheel 42 to be positioned between the two support bars 36. Each holder base 52 comprises an extension portion 62 of a semicircular cross section. The extension portion 62 extends from the recess 60 in direction toward the bicycle wheel 42. Each holder base 52 further comprises an end plate 64 located at the distal end of the extension portion 62. Thus, the extension portion 62 defines a partition space 66 between the end plate 64 and the holder base 52.

The engagement member 54 comprises a mounting groove 68, two lugs 70 bilaterally located at a top side thereof, an insertion hole 72 disposed between the two lugs 70 in communication with the mounting groove 68, and a first through hole 74 located in a bottom side thereof. The mounting groove 68 is defined between the first through hole 74 and the lugs 70. A first pivot pin 76 is inserted through the end plate 64, the first through hole 74 and the holder base 52 to pivotally couple the engagement member 54 to the partition space 66 of the holder base 52. The first pivot pin 76 is kept in parallel to the axial direction 46 of the wheel axle 44. Thus, the engagement member 54 can be biased in the partition space 66 relative to the holder base 52, moving the mounting groove 68 out of the recess 60 of the holder base 52 (see FIG. 5), or into the inside of the recess 60 of the holder base 52 (see FIG. 4).

Figure 5:
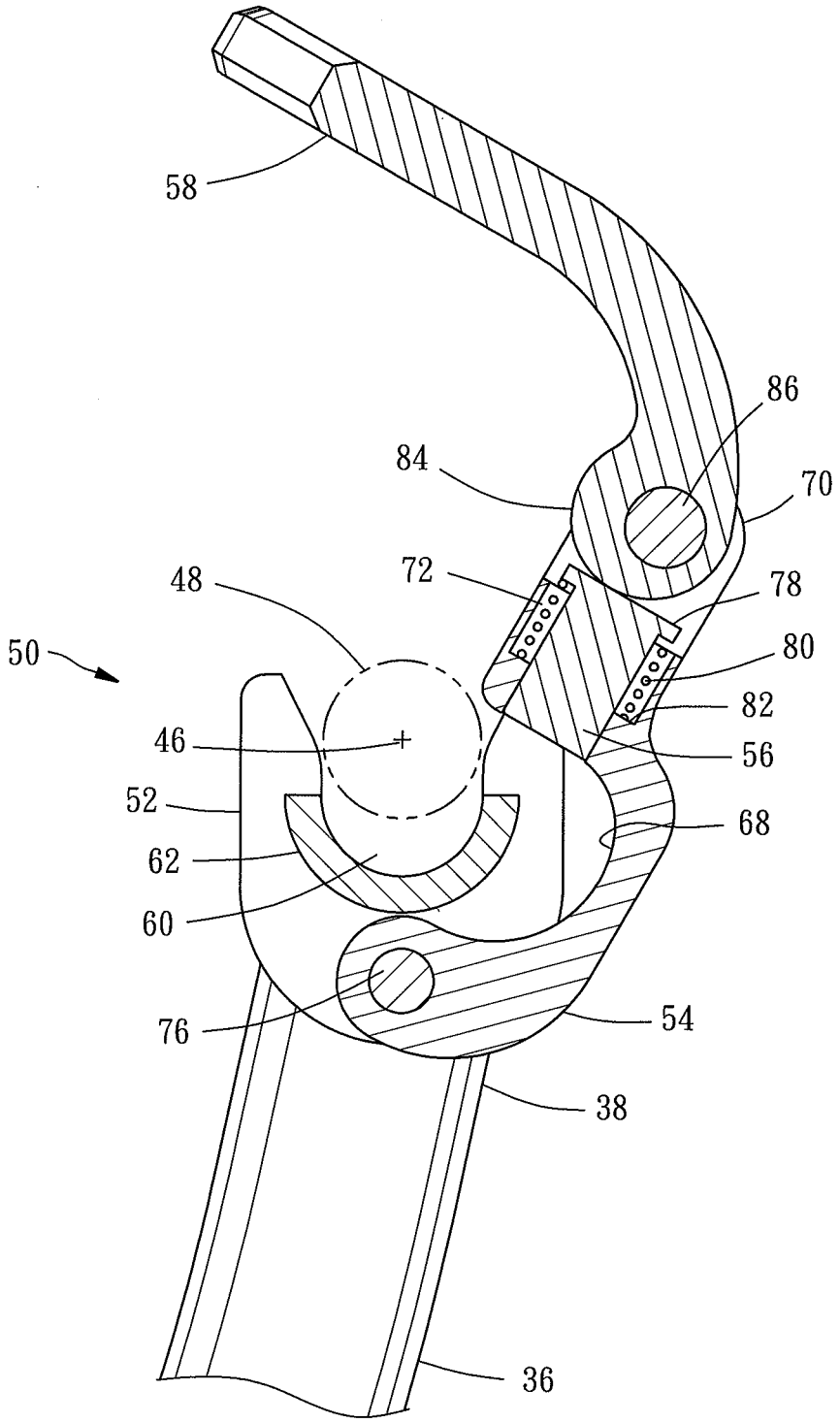
FIG. 5 is a sectional view of a part of the bicycle trainer in accordance with the first embodiment of the present invention, illustrating the quick-release device separated from the holding fixture.
Figure 6:
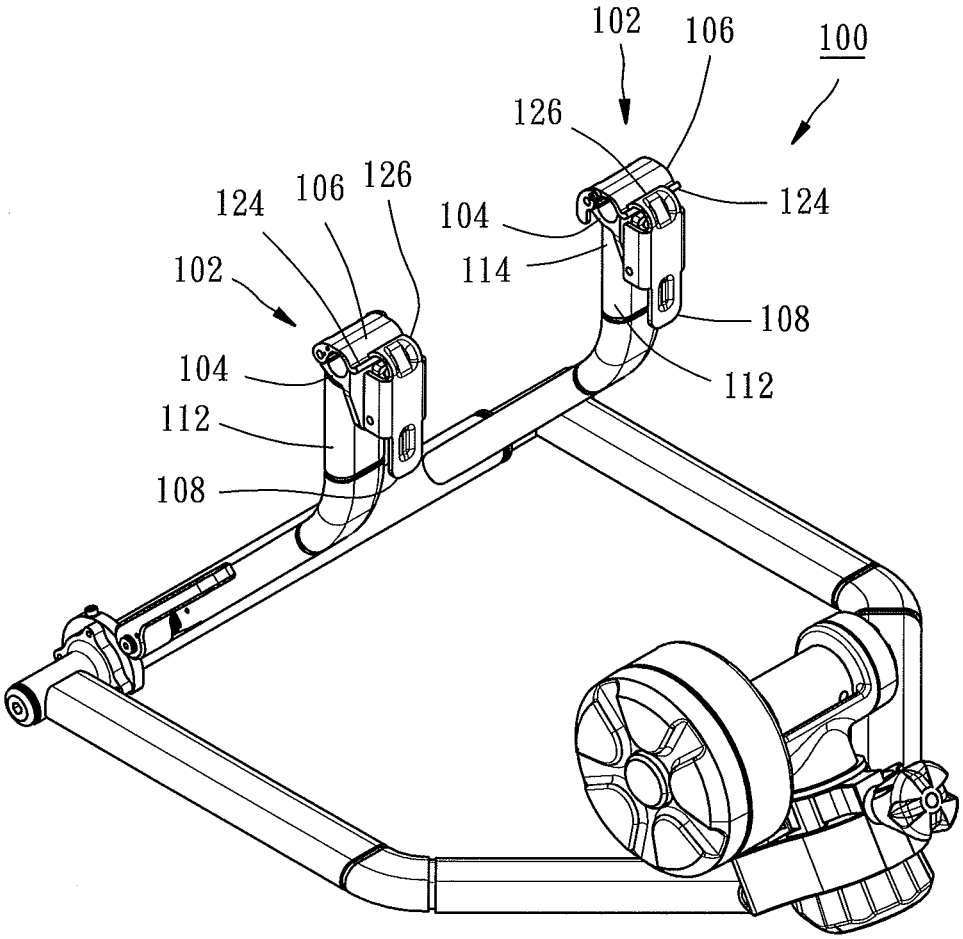
FIG. 6 is an oblique top elevational view of a bicycle trainer in accordance with a second embodiment of the present invention.
Figure 7:
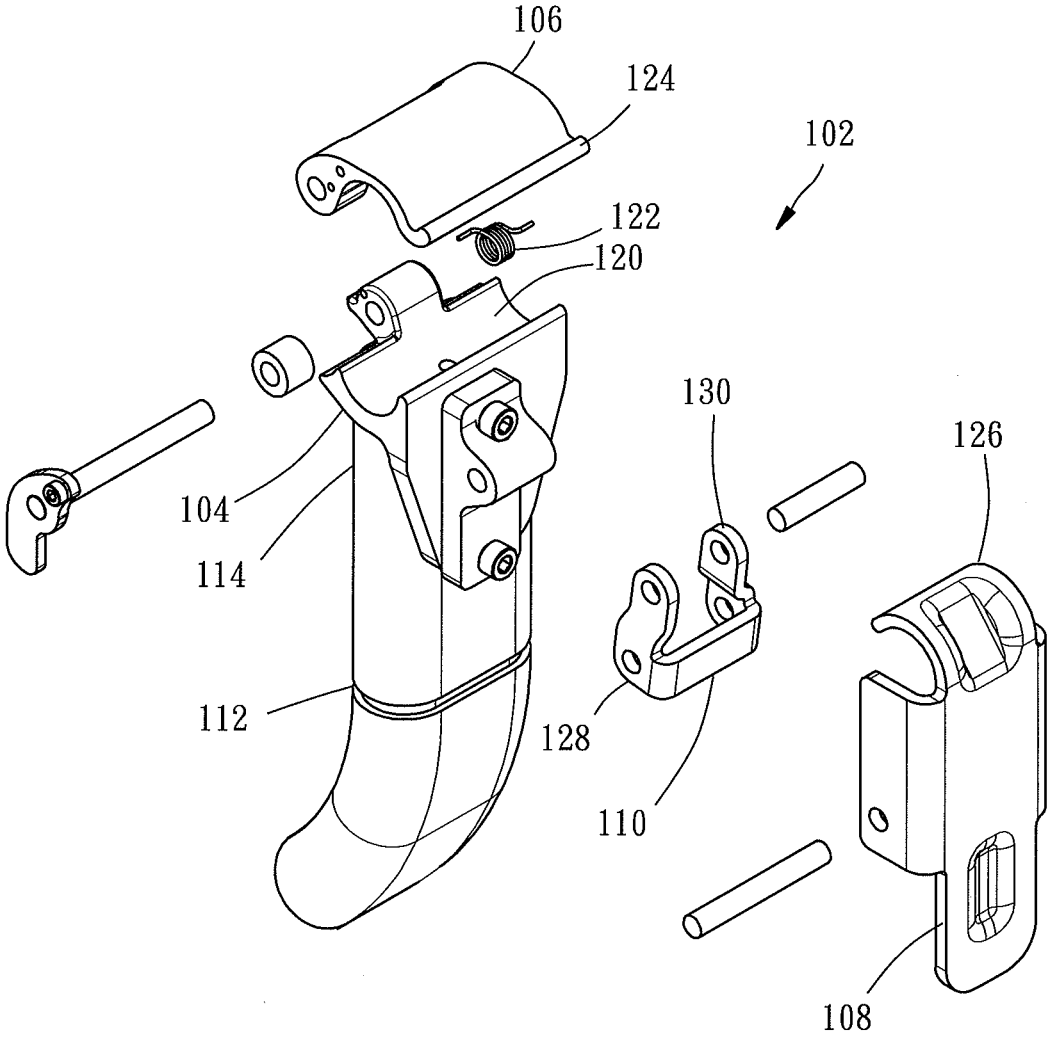
FIG. 7 is an exploded view of a part of the bicycle trainer in accordance with the second embodiment of the present invention, illustrating the configuration of the holding fixture.

In the first embodiment of the present invention, the holding-down member 56 is a cylindrical member, having a head 78 at one end thereof. The outer diameter of the head 78 is larger than the outer diameter of the other part of the holding-down member 56. As illustrated in FIGS. 3 through 5, the holding-down member 56 is inserted through a compression spring 80, and then mounted in the insertion hole 72 of the engagement member 54. The compression spring 80 has one end thereof stopped at the head 78 of the holding-down member 56, and an opposite end thereof stopped at a shoulder 82 inside the insertion hole 72. The lever 58 comprises a cam portion 84 disposed between the two lugs 70 of the engagement member 54. A second pivot pin 86 is inserted through the two lugs 70 and the cam portion 84 to pivotally couple the lever 58 to the engagement member 54. The cam portion 84 is stopped at the head 78 of the holding-down member 56. Thus, the lever 58 can be biased between a locking angle (see FIG. 4) and an unlocking angle (see FIG. 5). As illustrated in FIG. 4, when the lever 58 is in the locking angle, the cam portion 84 forces the holding-down member 56 toward the mounting groove 68, enabling a part of the holding-down member 56 to project into the mounting groove 68. As illustrated in FIG. 5, when the lever 58 is biased to the unlocking angle, the elastic restoring force of the compression spring 80 pushes the holding-down member 56 back to the inside of the insertion hole 72 of the engagement member 54.

Based on the components of the first embodiment of the present invention described above, when going to secure the bicycle wheel 42 to the support bars 36 of the swivel frame 32, the user simply needs to bias the lever 58 to the unlocking angle to move the engagement member 54 out of the holder base 52 and to further expose the recess 60 to the outside, and the to put the bicycle wheel 42 with the equipped quick-release device 48 onto the swivel frame 32 directly by one single hand or both hands in a direction non-coaxial to the axial direction 46 of the wheel axle 44. In this first embodiment, the direction non-coaxial to the axial direction 46 of the wheel axle 44 is the direction of gravity, i.e., put the bicycle wheel 42 vertically downwardly into the recesses 60. After the bicycle wheel 42 is put in position, the user can then receive the engagement members 54 to the respective holder bases 52 to keep the respective mounting grooves 68 in the respective recesses 60, and then bias the levers 56 of the clamp assemblies 50 to the locking angle where the holding-down members 56 are forced by the respective cam portions 84 to project into the respective mounting grooves 68 and to hold down the quick-release device 48, thereby securing the quick-release device 48 to the two holder bases 52 of the holding fixture 40, and thus the bicycle wheel 42 is quickly locked to the body 20 of the bicycle trainer 10.

As stated above, the bicycle wheel 42 can be positioned in the support bars 36 after having been directly placed on the holder bases 52 of the holding fixture 40 in the direction of gravity, thus, the user needs to repeatedly adjust the screw bolts to lock the bicycle wheel in position like the prior art design. Therefore, the invention provides an effect of pre-positioning the bicycle wheel 42. Further, the user simply needs to put the bicycle wheel 42 in the recesses 60, and then to simultaneously bias the engagement members 54 and the levers 58, forcing the holding-down members 56 to hold down the quick-release device 48 and the bicycle wheel 42. This operation is easy and fast, and can accurately lock the bicycle wheel 42. When compared with conventional bicycle trainers, the invention has the advantage of capable of rapidly securing the bicycle wheel in position. It's worth mentioning that the bicycle wheel 42 is mounted in the swivel frame 32 in a non-coaxial direction relative to the wheel axle 44 and the holding fixture 40 vertically secures the bicycle wheel 42 from the top and bottom sides, and therefore the bicycle trainer 10 can more accurately and tightly secure the bicycle wheel in position. The overall structure of the invention is more stable. Using the holding fixture 40 to work with the quick-release device 48 for securing the bicycle wheel 42 in position avoids causing damage to the bicycle frame. Therefore, the invention achieves the effect of conveniently and rapidly securing the bicycle wheel in position.

Figure 8:
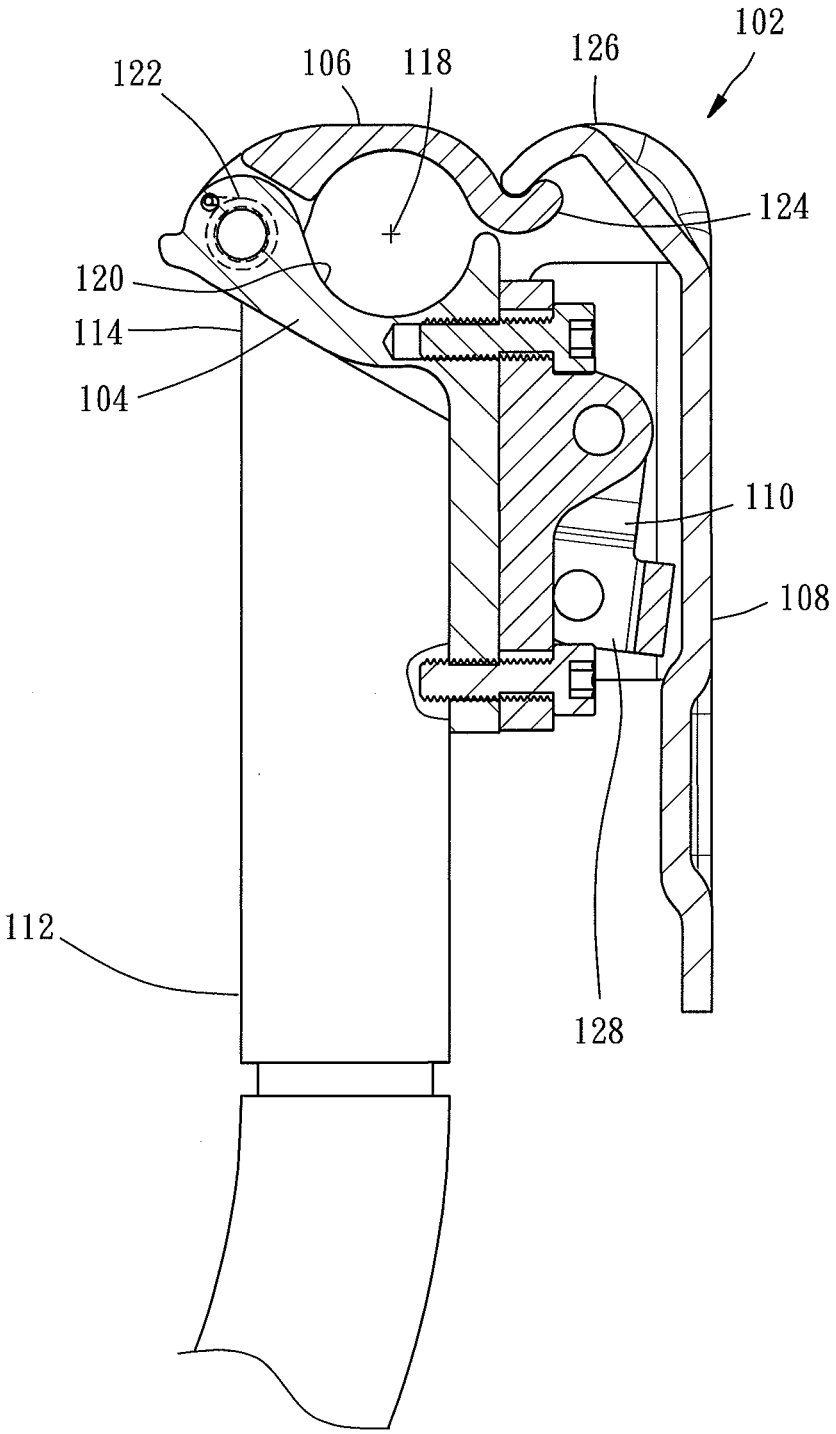
FIG. 8 is a sectional view of a part of the bicycle trainer in accordance with the second embodiment of the present invention, illustrating the quick-release device secured to the holding fixture.
Figure 9:
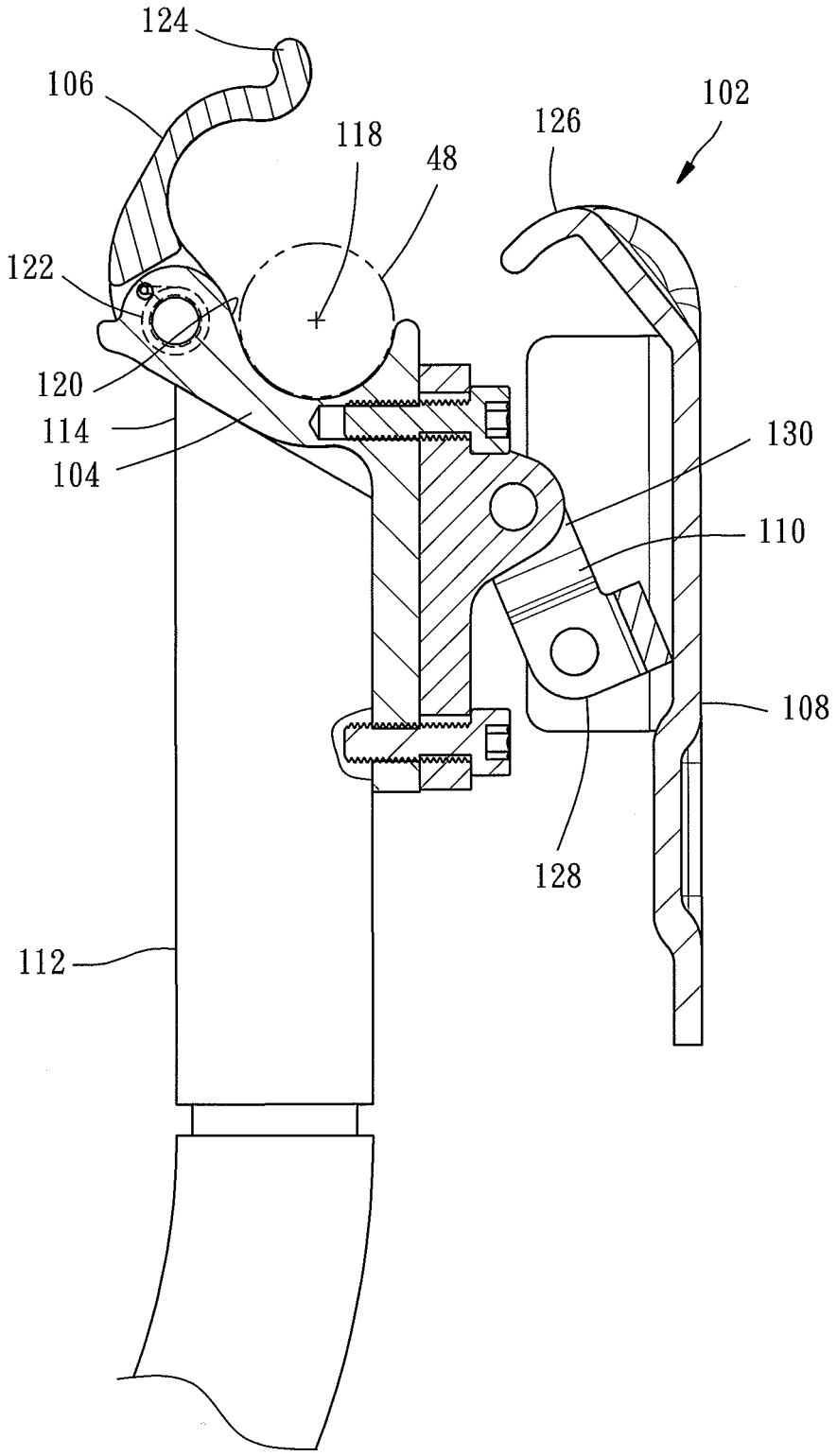
FIG. 9 is a sectional view of a part of the bicycle trainer in accordance with the second embodiment of the present invention, illustrating the quick-release device separated from the holding fixture.
Figure 10:
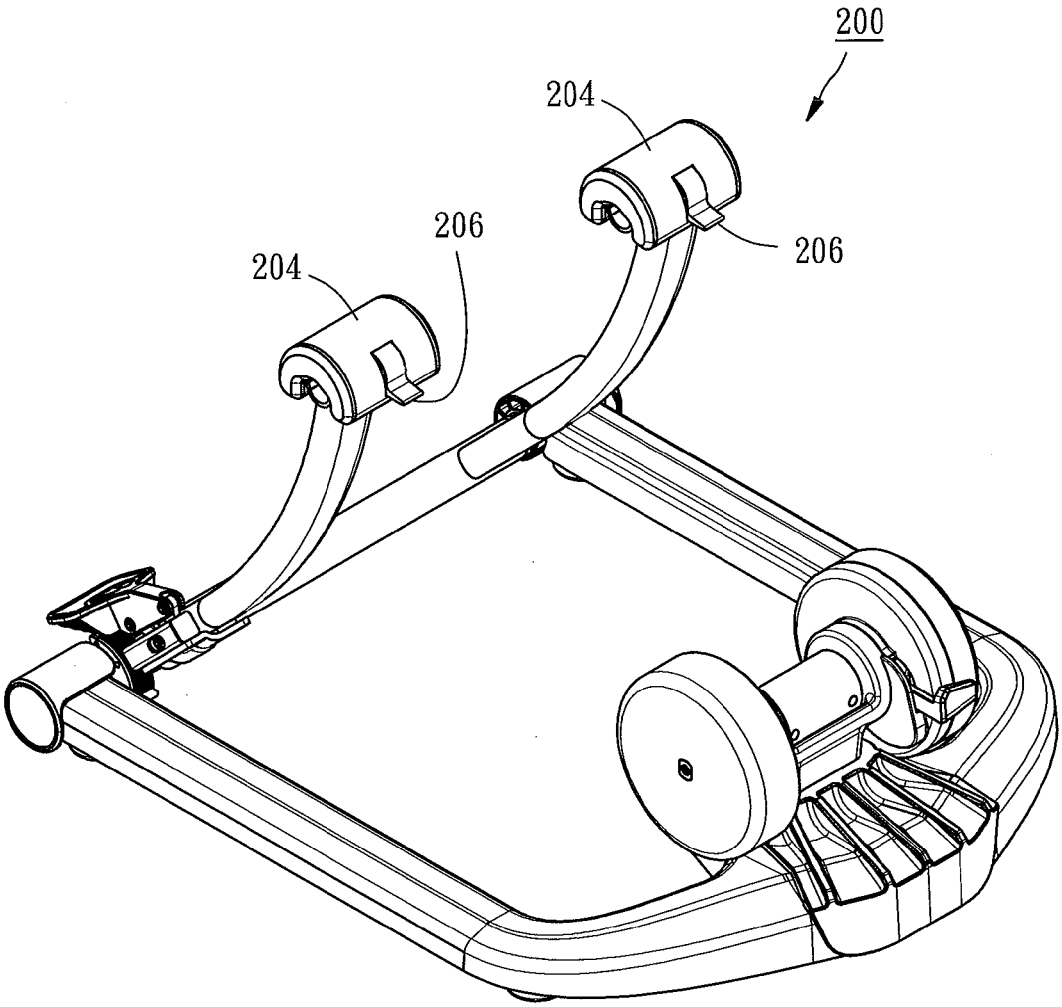
FIG. 10 is an oblique top elevational view of a bicycle trainer in accordance with a third embodiment of the present invention.
Figure 11:
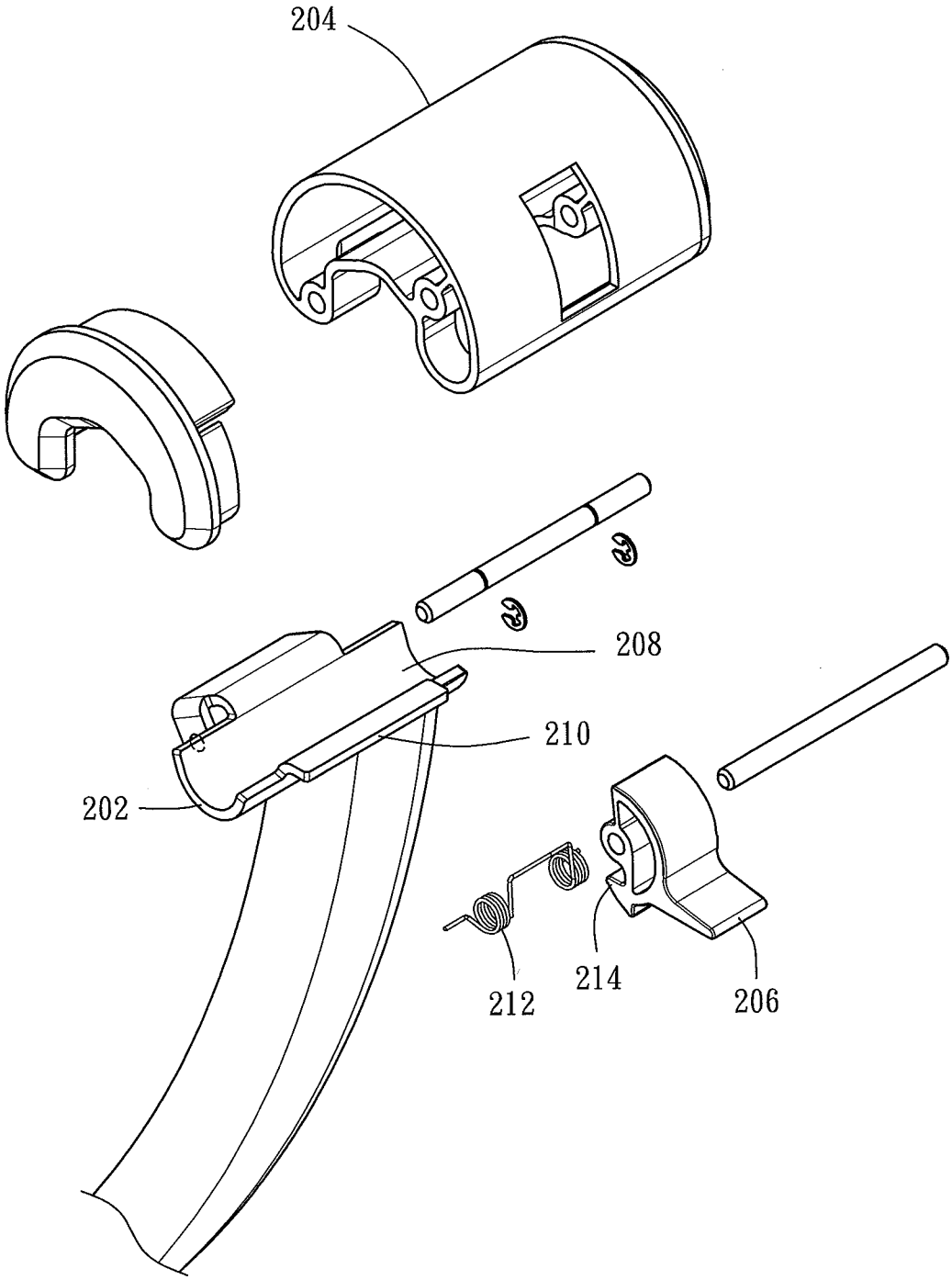
FIG. 11 is an exploded view of a part of the bicycle trainer in accordance with the third embodiment of the present invention, illustrating the configuration of the holding fixture.

Referring to FIGS. 6-9, a bicycle trainer 100 with a bicycle wheel holding fixture in accordance with a second embodiment of the invention is shown. This second embodiment is substantially similar to the aforesaid first embodiment with the exception that the holding fixture uses a linkage to hold down the of the quick-release device 48 of the bicycle wheel. The holding fixture comprises also two clamp assemblies 102. Each clamp assembly 102 comprises a holder base 104, a cover member 106, a lever 108, and a connecting member 110. The holder base 104 is mounted at the positioning portion 114 of the respective support bar 112. The holder base 104 comprises a recess 120 extending in the axial direction 118 of the wheel axle of the bicycle wheel. The recess 120 has a semicircular cross section with the open side thereof facing upwards. The cover member 106 is pivotally coupled to the holder base 104 at one lateral side relative to the recess 120, and adapted for closing the recess 120 of the holder base 104. Further, the cover member 106 is supported on a torsion spring 122 that imparts a biasing force to the cover member 106 to bias the cover member 106 in direction away from the recess 120. The cover member 106 has a retaining portion 124 located at the distal end thereof. The lever 108 comprises a hook 126. The lever 108 is pivotally connected with the body thereof to a first pivot-connection portion 128 of the connecting member 110. A second pivot-connection portion 130 of the connecting member 110 is pivotally connected to the holder base 104. Thus, the connecting member 110 is pivotally coupled between the lever 108 and the holder base 104, allowing the lever 108 to be biased relative to the holder base 104. As illustrated in FIG. 8, the lever 108 can be biased to the position where the hook 126 is hooked on the retaining portion 124 of the cover member 106 to lock the cover member 106 to the holder base 104 in closing the recess 120 and to further securing the quick-release device 48 in position. Alternatively, as illustrated in FIG. 9, the lever 108 can be biased in the reversed direction to release the hook 126 from the retaining portion 124 of the cover member 106 so that the cover member 106 can be opened from the holder base 104, allowing removal of the quick-release device 48 out of the recess 60. The linkage design of the holding fixture for securing the bicycle wheel not only can achieve the same effects and objects as the aforesaid first embodiment but also greatly enhance the overall securing strength.

Figure 12:
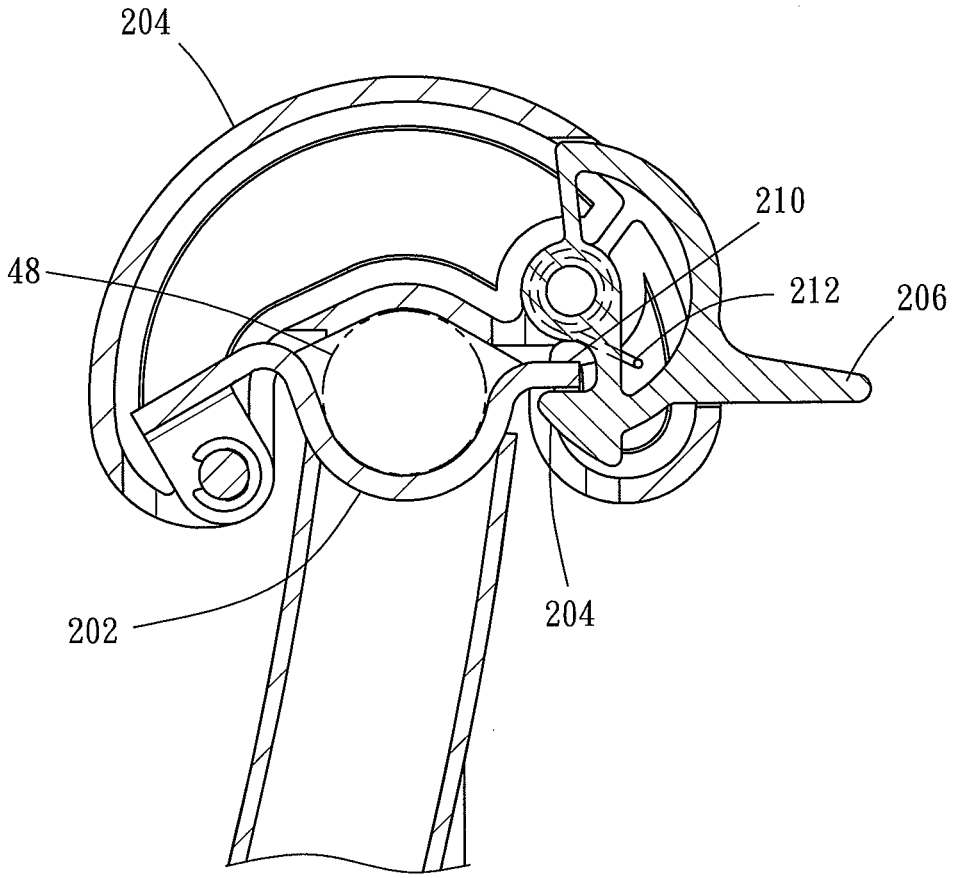
FIG. 12 is a sectional view of a part of the bicycle trainer in accordance with the third embodiment of the present invention, illustrating the quick-release device secured to the holding fixture.
Figure 13:
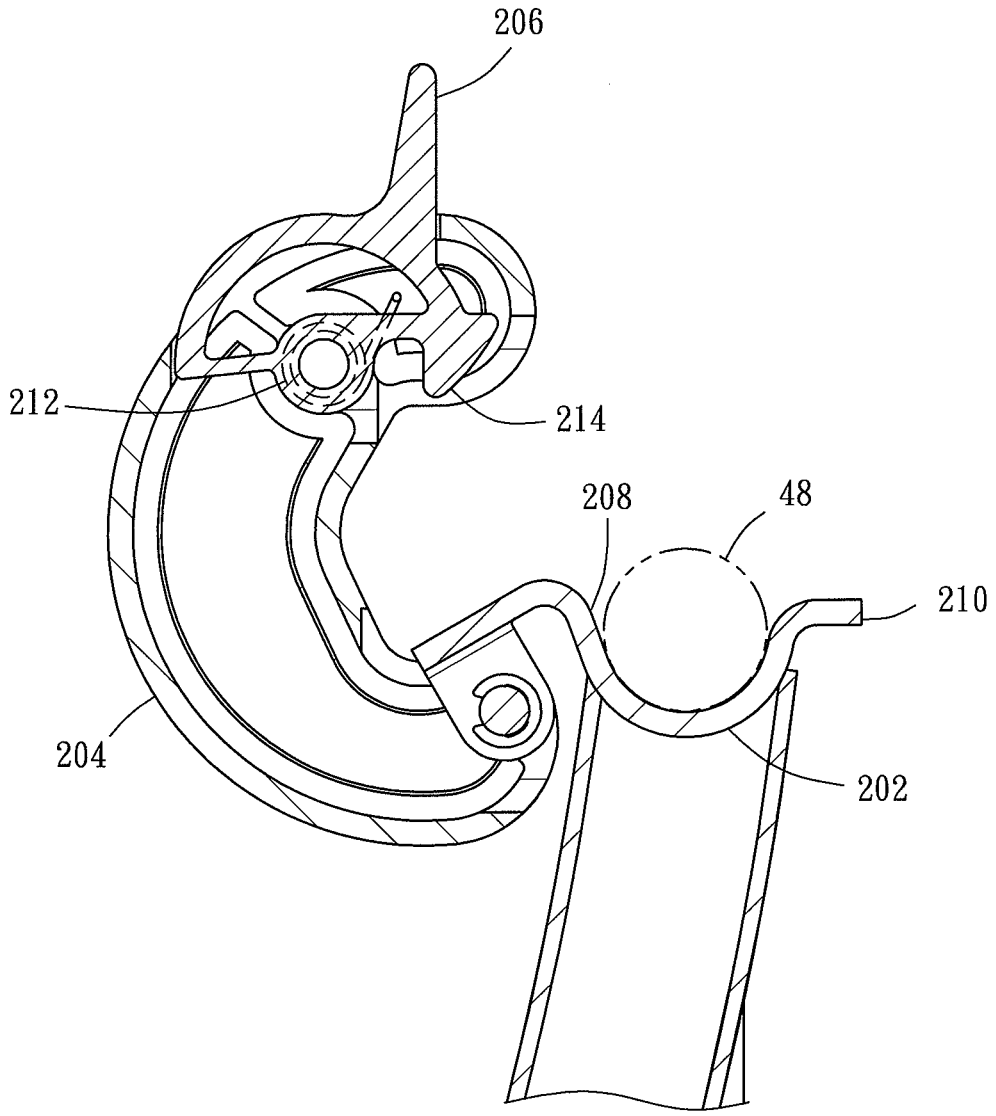
FIG. 13 is a sectional view of a part of the bicycle trainer in accordance with the third embodiment of the present invention, illustrating the quick-release device separated from the holding fixture.

Referring to FIGS. 10-13, a bicycle trainer 200 with a bicycle wheel holding fixture in accordance with a third embodiment of the invention is shown. This third embodiment is substantially similar to the aforesaid second embodiment with the exception of the structural design of the holding fixture. According to this third embodiment, the holding fixture comprises a holder base 202, a cover member 204, and a hook member 206. The holder base 202 comprises a recess 208, and a locating portion 210 disposed adjacent to one lateral side of the recess 208. The cover member 204 is designed to have a flexible structure. In this third embodiment, the cover member 204 has a hollow arched shape, and is pivotally connected with one side thereof to the holder base 52. The hook member 206 is mounted at an opposite side of the cover member 204 to face toward the locating portion 210. Further, a torsion spring 212 is provided between the hook member 206 and the cover member 204. As illustrated in FIG. 12, the elastic restoring force of the torsion spring 212 is adapted to bias the hook member 206 in moving a hooked portion 214 thereof in the clockwise direction. Therefore, when the cover member 204 closes the recess 208 of the holder base 202. By means of the structural elasticity of the cover member 204, the cover member 204 can be compressed to hold down the quick-release device 48, and the hooked portion 214 of the hook member 206 can engage the locating portion 210, securing the cover member 204 tightly to the holder base 202. As illustrated in FIG. 13, when the hook member 206 is biased in the counter-clockwise direction, the hooked portion 214 is disengaged from the locating portion 210 of the holder base 202, and thus, the cover member 204 can be opened for allowing removal of the quick-release device 48 from the holder base 202. Thus, this third embodiment simplifies the component arrangement, achieving the same effects and purposes of the aforesaid first and second embodiments. It is to be noted that the invention is characterized by the technical feature that the holding fixture secures the bicycle wheel in a non-coaxial direction relative to the axial direction of the wheel axle. Except the aforesaid linear direction of gravity, this non-coaxial direction relative to the axial direction of the wheel axle can extend obliquely or in a curved manner to let the bicycle wheel be positioned in position and then locked by the holding fixture.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bicycle trainer adapted for securing a bicycle wheel, said bicycle wheel being rotatable on a wheel axle, the bicycle trainer comprising:

a body comprising two positioning portions for supporting said wheel axle to keep said bicycle wheel between said two positioning portions;

a damper unit mounted at said body and adapted to provide a damping resistance to said bicycle wheel; and a holding fixture mounted at said positioning portions of said body and adapted for securing said bicycle wheel along a non-coaxial direction relative to an axial direction of said wheel axle, wherein said holding fixture comprises two clamp assemblies, each said clamp assembly comprising a holder base and a cover member, each said holder base being respectively mounted at said positioning portions of said body, each said holder base comprising a recess in axial alignment with the axial direction of said wheel axle, said cover member being pivotally connected to said holder base and adapted for closing and opening said recess.

2. The bicycle trainer as claimed in claim 1, wherein said non-coaxial direction relative to the axial direction of said wheel axle is the direction of gravity.

3. The bicycle trainer as claimed in 1, wherein said body comprises a framework and a swivel frame pivotally connected to said framework, said swivel frame comprising two support bars extending in a parallel relationship toward said damper unit; said two positioning portions are respectively located at said support bars.

4. The bicycle trainer as claimed in claim 1, wherein said holding fixture further comprises a lever and a connecting member, said lever comprising a hook, said cover member comprising a retaining portion, said connecting member being pivotally coupled between said lever and said holder base such that said lever is movable to hook said hook on said retaining portion of said cover member or to disengage said hook from said retaining portion of said cover member.

5. The bicycle trainer as claimed in claim 1, wherein said bicycle wheel is equipped with a quick-release device, said quick-release device being detachably mountable at said two positioning portions of said body.

6. The bicycle trainer as claimed in claim 1, wherein said body comprises a framework and a swivel frame pivotally connected to said framework, said swivel frame comprising two support bars arranged in parallel, each said support bar top having a top end thereof terminating in one said positioning portion, said two support bars being biasable relative to said framework between two positions where said support bars are lifted from said framework or received to said framework; said damper unit is mounted at said framework to face toward said support bars of said swivel frame.

7. The bicycle trainer as claimed in claim 1, wherein said holding fixture comprises two clamp assemblies, each said clamp assembly comprising a holder base, an engagement member, a holding-down member and a lever, each said holder base comprising a recess for supporting said wheel axle of said bicycle wheel, said engagement member being pivotally connected to said holder base, said holding-down member being movably mounted at said engagement member, said lever being pivotally connected to said engagement member for moving said holding-down member away from said bicycle wheel or in holding down said bicycle wheel.

8. The bicycle trainer as claimed in claim 1, wherein said holding fixture comprises two clamp assemblies, each said clamp assembly comprising a holder base and a cover member, said holder base comprising a locating portion, said cover member having a hook member pivotally connected thereto, the two holder bases of said two clamp assemblies being respectively mounted at said two positioning portions, said holder base comprising a recess extending in the axial direction of said wheel axle, said cover member being pivotally connected to said holder base and adapted for closing said recess of said holder base, said hook member being hooked on said locating portion when said cover member closes said recess.

* * * * *